United States Patent [19]

Lee

[11] Patent Number: 4,871,123

[45] Date of Patent: Oct. 3, 1989

[54] PAPER ROLL HOLDING DEVICE

[76] Inventor: Raymond N. Lee, 9512 Woody La., Great Falls, Va. 22066

[21] Appl. No.: 212,080

[22] Filed: Jun. 28, 1988

Related U.S. Application Data

[63] Continuation of Ser. No. 13,787, Feb. 12, 1987, abandoned.

[51] Int. Cl.[4] ..... B65H 16/04

[52] U.S. Cl. ..... 242/55.2

[58] Field of Search ..... 242/55.2, 55.3, 55.42, 242/55.53, 55.54, 55.55; 211/99, 100, 105.1; 248/291, 293; D6/522, 523

[56] References Cited

U.S. PATENT DOCUMENTS

| | | | |
|---|---|---|---|
| 432,738 | 7/1890 | Morgan | 242/55.2 |
| 765,588 | 7/1904 | McGown | 242/55.2 |
| 1,047,535 | 12/1912 | Kearney | 242/55.2 |
| 1,069,757 | 8/1913 | Bens et al. | 242/55.2 |
| 1,119,135 | 12/1914 | Anderson | 211/99 |
| 1,156,266 | 10/1915 | Bens et al. | 242/55.2 |
| 1,322,524 | 11/1919 | Bovee | 242/55.2 |
| 1,398,646 | 11/1921 | Murray | 242/55.2 |
| 1,889,024 | 11/1932 | Marsh | 242/55.2 |
| 1,892,687 | 1/1933 | Teufel | 211/99 |
| 1,897,266 | 2/1933 | McGeoch et al. | 242/55.2 |
| 2,467,825 | 4/1949 | Hall | 242/55.2 |
| 2,566,883 | 9/1951 | Gove | 242/55.2 |
| 3,155,333 | 11/1964 | Jend | 242/129.5 |
| 3,227,386 | 1/1966 | Pitcher | 242/55.2 |
| 3,346,208 | 10/1967 | Hoffman et al. | 242/55.2 |
| 4,483,491 | 11/1984 | Rainey | 242/55.2 |
| 4,556,160 | 12/1985 | Kurz et al. | 242/55.2 X |

FOREIGN PATENT DOCUMENTS

| | | | |
|---|---|---|---|
| 37068 | 7/1935 | Netherlands | 242/55.2 |
| 283003 | 9/1952 | Switzerland | 242/55.2 |
| 2057394 | 4/1981 | United Kingdom | 242/55.2 |

*Primary Examiner*—Joseph J. Hail, III

*Attorney, Agent, or Firm*—Birch, Stewart, Kolasch & Birch

[57] ABSTRACT

The present invention relates to a holding device for readily mounting a paper roll in a hanging bar thereof, which comprises a hanging bar attached to a support member which is pivotably attached to a base member whereby the pivotable support member can be rotated in either the vertical plane relating to the base member for readily mounting the paper roll to the paper roll holding device.

4 Claims, 2 Drawing Sheets

PAPER ROLL HOLDING DEVICE

This application is a continuation of application Ser. No. 013,787, filed on Feb. 12, 1987, now abandoned.

BACKGROUND OF THE INVENTION

The present invention relates to a paper roll holding device such as a toilet paper roll holder, or a paper towels roll holder or the like for use, for example, in a bathroom, a kitchen or the like. More particularly, the present invention is directed to a paper roll holding device for readily hanging a roll of paper to a hanging bar, which can be operated with little effort, particularly when loading and unloading the holding device with the paper roll.

There are many types of paper roll holders which are well known in the art which utilize a retaining spring which is strongly biased against a hanger to resist the separation of the hanger from a supporting member. However, these paper roll holders suffer from a number of difficulties such as, for example, they are complicated in structure, expensive to manufacture, and in many cases, are difficult to operate. Furthermore, the user is required to separate the paper roll hanger from the supporting member against the bias of the retaining spring which causes some effort and technique by the user.

OBJECTS AND SUMMARY OF THE INVENTION

Accordingly, it is an object of the present invention to provide an improved paper roll holding device.

Another object of the present invention is to provide a paper roll holding device for readily hanging a roll of paper such as toilet paper or paper towels thereon.

A further object of the present invention is to provide a paper roll holding device which is structured with a pivotable support member having a hanging bar and which is easy to operate with little effort being required by the user when compared with conventional paper roll holders.

Still another object of the present invention is to provide an improved paper roll holding device to which can be readily mounted a roll of paper to a hanging bar or from which a waste roll of the paper can be readily removed from the hanging bar thereof.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a paper roll holding device for readily mounting a paper roll on a hanging bar thereof, which comprises the hanging bar attached to a support member which is pivotably attached to a base member whereby the support member can be rotated in the vertical plane relating to the base member for readily mounting the paper roll to the paper roll holding device.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
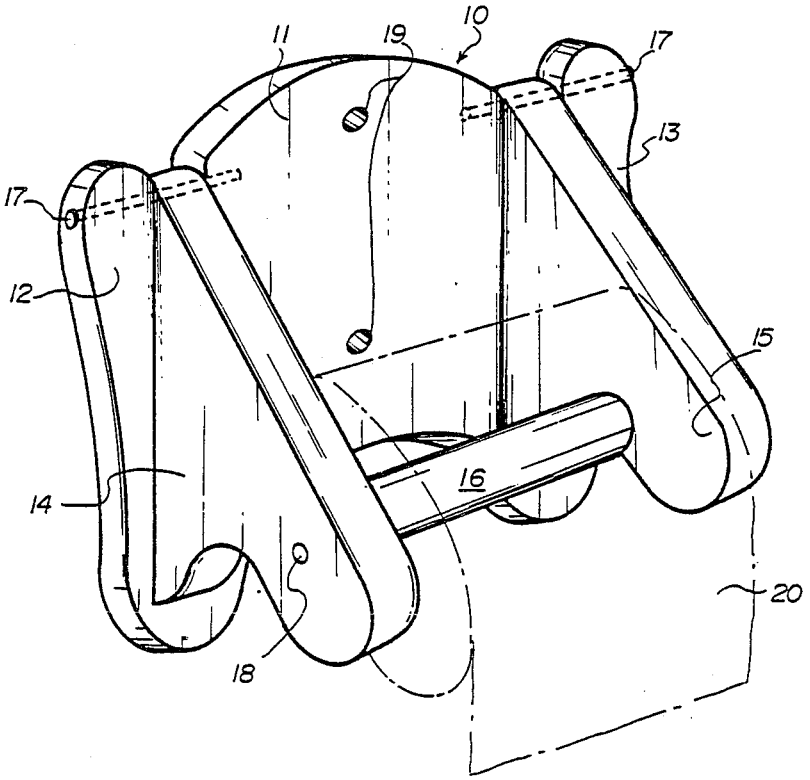
FIG. 1 is a perspective view of the paper roll holding device of the present invention.

Referring now in detail to the drawings for the purpose of illustrating preferred embodiments of the present invention, the paper roll holding device 10 as shown in FIG. 1 comprises a base member 11 having a left wing portion 12 and a right wing portion 13. A left support member 14 and a right support member 15 are pivotably attached to both wing portions 12 and 13 respectively. The hanging bar 16 can be attached to either the left or right support member. Although both support members 14 and 15 can be pivotable, it is readily apparent that only of the support members needs to be pivotably mounted to the base member 11 to provide ready access to the hanging bar 16 for inserting a paper roll 20 thereon.

The base member 11 includes a plurality of apertures 19 through which a nail or a bolt 18 can be inserted for attaching the base member 11 to the wall of a bathroom, a kitchen, or the like. The upper ends of the left and right support members 14 and 15 are pivotably attached to upper ends of the left and right wing portions 12 and 13 through connecting pins 17. In FIG. 1, the left support member 14 contains the hanging bar 16 attached at the lower end thereof by the bolt 18. The hanging bar 16, as previously stated, can also be attached to the lower end of the right support member 15.

Figure 2:
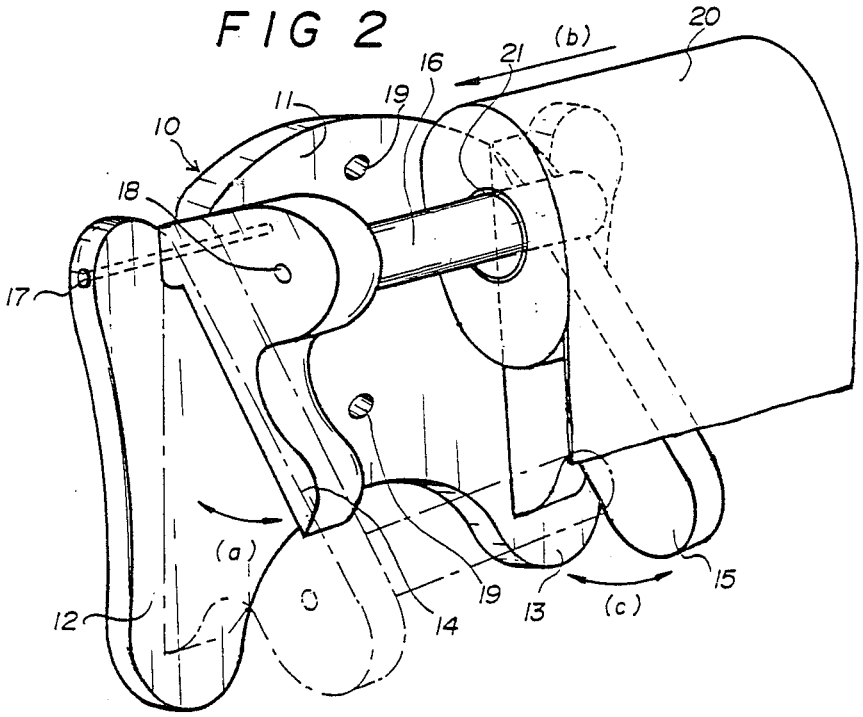
FIG. 2 is a perspective view of the paper roll holding device of the present invention showing the support member having the hanging bar which is attached thereto in a pivotable separated position from the base member with the hanging bar in its loading position whereby the paper roll can be easily inserted into the hanging bar.

In operation, as shown in FIG. 2, after the user lifts up the left support member 14 in the direction indicated by arrow (a) from the paper dispensing position to the lifted or loading position, the paper roll 20 disposed on the axial cardboard support 21 is inserted onto the hanging bar 16 in the direction indicated by arrow (b) as shown in FIG. 2. After the paper roll 20 is mounted on the hanging bar 16, the left support member 14 is automatically returned to its original position when the user releases it in the direction indicated by arrow (a). At this time, the holding device can be operated with little effort being required by the user.

Because the hanging bar is slightly shorter than the distance between the left and right support members 14 and 15, the paper roll 20 is free to rotate on the hanging bar but at the same time is prevented from separating from the hanging bar 16 by the support members. If necessary, the hanging bar 16 can be secured to the right support member 15 disposed at the right wing portion 13 of the base member 11. Therefore, at this time, the right support member 15 can be separated from the base member 11 in the direction indicated by arrow (c) as shown in FIG. 2.

Figure 3:
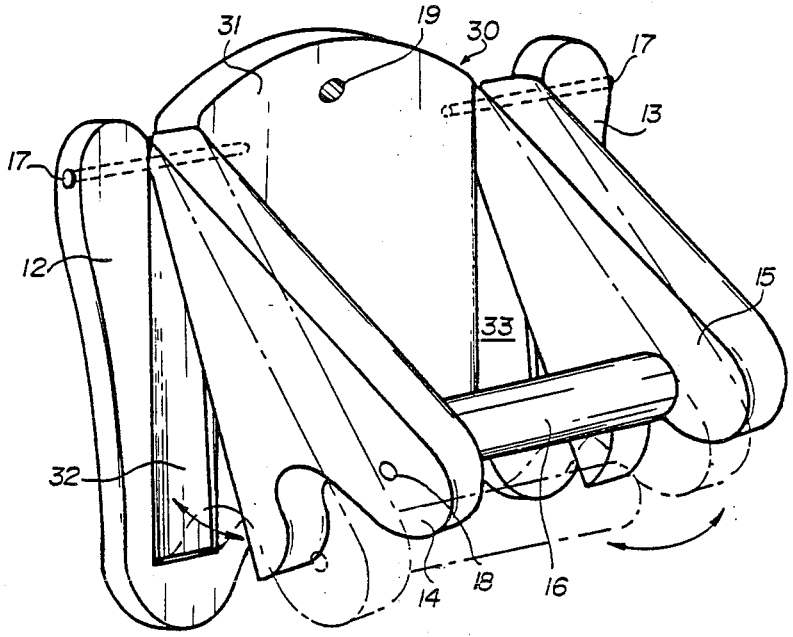
FIG. 3 is a perspective view of another embodiment of the paper roll holder of the present invention wherein the support member is adapted to engage a slot provided in the base member.

Referring in detail to FIG. 3, there is illustrated another embodiment of a paper roll holding device 30 in accordance with the present invention. The base member 31 of the paper roll holding device 30 of the present invention contains left and right slots 32 and 33 disposed at the left and right wing portions 12 and 13 thereof for engaging the left and right support members 14 and 15 respectively, whereby both support members 14 and 15 can be tightly engaged in both slots 32 and 33 while the user uses chiefly the paper roll 20 after defecation and urination or washing the hands.

Figure 4:
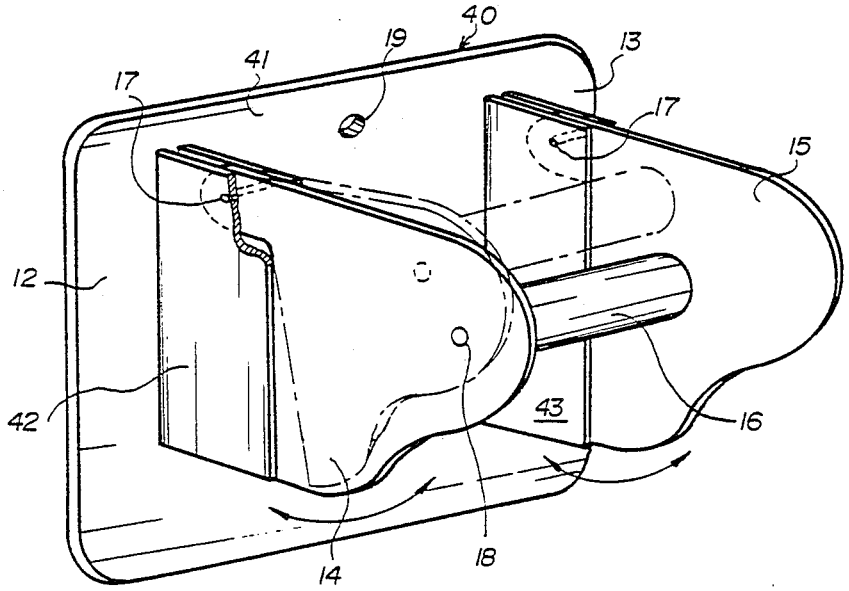
FIG. 4 is a perspective view of a further embodiment of the paper roll holder of the present invention wherein a supporting plate is attached to the base member and the support member is pivotably mounted to the supporting plate.

Referring in detail to FIG. 4, there is illustrated still another embodiment of the paper roll holding device 40 according to the present invention. The base member 41 of the paper roll holding device of the present invention includes left and right supporting plates 42 and 43 disposed at the left and the right wing portions 12 and 13 thereof for pivotably connecting both support members 14 and 15 thereto.

The paper roll holding devices 10, 30 and 40 can be made of wood, metal, plastic or like material. Particularly, the base member 41 and both supporting plates 42 and 43 as shown in FIG. 4 are preferably made of a metallic material.

Because the paper roll holding device 10, 30 and 40 of the present invention comprises a support member 14 or 15 having a hanging bar 16 for readily mounting or removing a roll of paper 20 to or from the hanging bar 16, it is very convenient and easy to operate and is inexpensive to manufacture. Also, it can be operated with little effort being required by the user when compared with conventional paper roll holders.

The invention being thus described, it will be obvious that the same may be varied in many ways. Such variations are not to be regarded as a departure form the spirit and scope of the invention, and all such modifications as would be obvious to one skilled in the art are intended to be included in the scope of the following claims.

What is claimed is:

1. A paper roll dispensing device which comprises:

a base member having a front face, a top face and first and second side faces, said top face having first and second recesses therein, first and second side slots located on said front face and extending to said first and second recesses respectively, each of said first and second slots having opposed supporting walls and being formed as a groove in said front face, said groove of each of said first and second slots opening into said first and second recesses respectively, first and second side support members attached to said base member by attaching means, said first and second side support members being positioned in said first and second recesses respectively, said attaching means attaching said first and second side support members including a pivot pin extending from one of said base member side faces and through a hole located in the side support positioned in each of said first and second recesses, each of said first and second support members being pivotally mounted by said pivot pin for movement in a plane substantially parallel to the other support member and perpendicular to said base member and receiving lateral support from said side slot opposed supporting walls, a mounting bar secured to one of said side support members and located between said first and second support members, and said side support members being dimensioned to position said mounting bar so that a paper roll to be mounted on said mounting bar is always suspended free from contact with said base member, whereby upon the pivotal rotation of one of said side support members, the paper roll can be readily mounted to or removed from said mounting bar secured to one of said side support members.

2. The paper roll dispensing device of claim 1 wherein, said device is a toilet paper dispenser or a paper towel dispenser.

3. The paper roll dispensing device of claim 1 wherein, the base member contains plurality of apertures for mounting the dispensing device.

4. The paper roll dispensing device of claim 1 wherein, relative to its wall mounting position, said first and second side slots extend along said base member, in the vertical direction, for strongly engaging said first and second side support members respectively.

* * * * *